US005934494A

United States Patent [19]

Takahashi et al.

[11] Patent Number: 5,934,494

[45] Date of Patent: Aug. 10, 1999

[54] PACKING FOR LID

[75] Inventors: Hideyuki Takahashi; Hidetoshi Hatakeyama; Futoshi Nakaya; Yuichi Fujii, all of Tokyo, Japan

[73] Assignee: Mitsubishi Gas Chemical Company, Inc., Tokyo, Japan

[21] Appl. No.: 09/004,659

[22] Filed: Jan. 8, 1998

Related U.S. Application Data

[63] Continuation of application No. 08/343,954, Nov. 17, 1994, abandoned.

[30] Foreign Application Priority Data

| | | | |
|---|---|---|---|
| Nov. 19, 1993 | [JP] | Japan | 5-290767 |
| Nov. 19, 1993 | [JP] | Japan | 5-290768 |
| Nov. 19, 1993 | [JP] | Japan | 5-290769 |

[51] Int. Cl.[6] ..... B65D 85/72

[52] U.S. Cl. ..... 215/347; 215/228; 215/349; 206/204

[58] Field of Search ..... 215/228, 261, 215/347, 348, 349, 350, DIG. 2; 206/484, 484.1, 484.2, 204; 428/36.2, 64.1, 448, 447, 482, 315.5, 315.7, 315.9, 36.5, 36.7, 36.91, 218, 246, 252, 283, 286, 287

[56] References Cited

U.S. PATENT DOCUMENTS

| | | |
|---|---|---|
| 3,521,784 | 7/1970 | Gaines et al. . |
| 3,622,439 | 11/1971 | Manne et al. . |
| 4,279,350 | 7/1981 | King . |
| 4,287,995 | 9/1981 | Moriya . |
| 4,421,235 | 12/1983 | Moriya . |
| 4,756,436 | 7/1988 | Moriya et al. . |
| 5,143,763 | 9/1992 | Yamada et al. . |

FOREIGN PATENT DOCUMENTS

| | | |
|---|---|---|
| 0269066 | 6/1988 | European Pat. Off. . |
| 0326464 | 8/1989 | European Pat. Off. . |
| 2448488 | 2/1980 | France . |
| 2948264 | 6/1980 | Germany . |
| 54-148687 | 11/1979 | Japan . |
| 57-9746 | 1/1982 | Japan . |
| 63-219359 | 9/1988 | Japan . |
| 1177165 | 12/1989 | Japan . |
| 272851 | 3/1990 | Japan . |
| 286758 | 3/1990 | Japan . |
| 445144 | 2/1992 | Japan . |
| 445152 | 2/1992 | Japan . |

OTHER PUBLICATIONS

"Multiplayer Flexible Packaging", The Wiley Encyclopedia Of Packaging Technology, 1986, pp. 458, 575, 576, 620, 621.

"All About Converting: History and Future", Converting Technical Institute, 1993, pp. 98, 224–230 and partial translation.

*Primary Examiner*—Stephen K. Cronin
*Assistant Examiner*—Nathan Newhouse
*Attorney, Agent, or Firm*—Leydig, Voit & Mayer, Ltd.

[57] ABSTRACT

A packing for a lid to seal a container opening is provided comprising a packing body, including a packing material and a low gas permeable sheet laminated on a surface of the packing material adapted to face a container, a gas permeable sheet provided on a surface of the packing body adapted to face the container and an oxygen absorbing agent provided between the packing material and the gas permeable sheet, adjacent the gas permeable sheet.

27 Claims, 4 Drawing Sheets

PACKING FOR LID

This disclosure is a continuation of patent application Ser. No. 08/343,954, filed Nov. 17, 1994, now abandoned.

1. Field of the Invention

The present invention relates to a packing for a lid having an oxygen absorbing function, and used to seal a container opening. A packing for a lid according to the present invention has high liquid resistance, and thus may be used to seal various containers, such as a jar or a plastic bottle, in which juice, liquor, wine, other liquid drinks, shiokara, tsukudani, jam, marmalade, sake-fureiku or other foodstuffs containing a high volume of water are contained. A packing for a lid according to the present invention has significant effect on the maintenance of the quality of articles which easily deteriorate with oxygen, or which easily decay or transform with propagation of microbes.

2. Description of the Prior Art

Drinks, foodstuffs, pharmaceuticals and the like which easily deteriorate with the influence of oxygen have a problem in that they deteriorate because of oxygen contained in a packaging container when they are stored in a packaging container. As a means for solving this problem, a step of removing oxygen within a container has been adopted by using vacuum packaging or nitrogen substitution treatment when packaging foodstuffs. However, this method is not simple, and it is difficult to completely remove oxygen within the container. Such method is not necessarily satisfactory in terms of the maintenance of quality.

Recently, so-called "oxygen absorbing agent packaging," i.e. a step of enclosing an oxygen absorbing agent within the packaging container to make use of its significant oxygen removing effect, is widely used as a reliable and simple method of removing oxygen. Generally, a method consisting of enclosing an oxygen absorbing agent formed into a small bag made of a gas permeable material into a packaging container is adopted as the oxygen absorbing agent packaging, and at the same time, various methods of incorporating an oxygen absorbing agent into a lid portion to seal the container opening are also proposed. However, when the oxygen absorbing agent is incorporated into a lid portion, there arises a problem in a manner of attaching a bag-shaped oxygen absorbing agent because of its form. In order to solve this problem, various types of packing used to seal a lid with an oxygen absorbing function have been proposed.

For example, in the Japanese Utility Model Laid-Open Publication No.57-9746, a packing in which an oxygen absorbing agent is stored has been proposed. However, because of the use of a powder type oxygen absorbing agent disclosed in this Publication, an oxygen absorbing agent may attach on the outside surface of a packing material when the packing is manufactured, and thus the oxygen absorbing agent so attached may contaminate foodstuffs. Moreover, this packing has the disadvantage in that when a container is sealed with this packing, the volume of oxygen absorbed reaches the maximum capacity of the oxygen absorbing agent in a relatively short period because of the high oxygen permeability of the packing, and thus the oxygen content within the container increases.

In the Japanese Utility Model Laid-Open Publication No.1-177165, a packing material for a container comprising a laminated structure of foaming member/non-gas permeable film/oxygen absorbing film/deodorizing film/gas permeable film is proposed. However, this packing material has disadvantages in that it has a poor sealing property because the material in contact with the container opening is multilayered, and as in the packing disclosed in the Japanese Utility Model Laid-Open Publication No.57-9746, the oxygen permeability at the sectional area of the packing material is high, leading to a poor oxygen stopping function, and thus its oxygen absorbing capability cannot resist long-term use.

Accordingly, the property of conventional packing with an oxygen absorbing function to prevent oxygen entering from outside is insufficient. Moreover, the property to maintain an oxygen absorbing function within the container and the sealing property of such packing are insufficient. Therefore, conventional packing has many issues to be solved, and is not satisfactory.

The object of the present invention is to solve these issues of conventional packing, and to provide a packing for a lid capable of preventing exterior air from directly entering into the container through the side edge of the packing material. Moreover, the object of the present invention is to provide a packing for a lid capable of providing a long lasting oxygen absorbing functions to the oxygen absorbing agent.

SUMMARY OF THE INVENTION

A packing for a lid according to the present invention has a structure wherein a packing body comprises a packing material and a low gas permeable sheet laminated on the surface of the packing material on the side facing a container; a gas permeable sheet is provided on the surface of the packing body on the side facing the container; and an oxygen absorbing agent is provided between the packing body and the gas permeable sheet. Thereby, exterior air (atmosphere) is prevented from directly entering into the container through the side edge of the packing material. Furthermore, even when the side edge of the gas permeable sheet is exposed, the gas permeable sheet may substantially be non-gas permeable by bonding it to the packing body. Therefore, the present invention may provide a significant oxygen stopping property to the packing body, and cause the oxygen absorbing agent to have a long lasting oxygen absorbing function.

A packing for a lid according to the present invention may also comprise a structure wherein an aperture or cavity is provided in the surface of the packing body opening toward the container, the oxygen absorbing agent is stored in the aperture, and an opening of the aperture in which the oxygen absorbing agent is stored is sealed with a gas permeable film. By using this structure, exterior air entering from the side edge of the packing material passes through the aperture in which the oxygen absorbing agent is stored within the container. Since the exterior air is absorbed into the oxygen absorbing agent, essentially no air enters into the container.

Moreover, a packing for a lid according to the present invention may also comprise a structure wherein an aperture is provided in the packing body opening toward the container, a low gas permeable sheet is laminated on the inner wall of the aperture, the oxygen absorbing agent is stored in the aperture in which the low gas permeable sheet is laminated, and an opening of the aperture in which the oxygen absorbing agent is stored is sealed with a gas permeable film. A packing for a lid with this structure may sufficiently stop air from outside of the container from entering the inside of the aperture, since the inner wall of the aperture is protected by the low gas permeable sheet. In other words, exterior air entering from the side edge of the packing member is prevented from entering into the container by the low gas permeable sheet.

Moreover, a packing for a lid according to the present invention may also comprise a structure wherein an oxygen absorbing agent is provided on the low gas permeable sheet surface of the packing body, and is secured to the packing body by surrounding it with a gas permeable sheet. By this structure, exterior air entering from the side edge of the packing material is prevented from entering into the container by the low gas permeable sheet.

The aperture may be of any shape or size so long as the oxygen absorbing agent can be easily stored, and the manufacturing process or manner of attaching the packing is not hindered. However, a circular perforation is preferred.

By making the outer diameter of the gas permeable sheet smaller than the inner diameter of the container opening, the side edge of the gas permeable sheet is not exposed to the atmosphere when the container is closed with a lid. Therefore, exterior air is prevented from entering through the side edge of the gas permeable sheet, and a significant oxygen stopping property can be obtained, and thus a long lasting oxygen absorbing function of the oxygen absorbing agent can be ensured.

The shape of the gas permeable sheet according to the present invention is not intended to be limited nor is the shape of the opening of a container to be used limited to use of a circular shape. Therefore, if the gas permeable sheet or the container opening has a shape other than circular, the outer diameter of the gas permeable sheet and the inner diameter of the container opening refers to a diameter of a circle inscribed around the gas permeable sheet or the container opening, as applicable.

A plastic film may also be laminated on the surface of the packing material on the side facing the lid. Such a lamination enhances the adhesiveness between the packing body and the lid, as well as enhances the decorativeness of a packing for the lid. Moreover, it may further prevent the oxygen absorbing agent stored in the aperture from contacting the atmosphere.

There will be no restriction on the composition of the plastic film. For example, films listed later as examples of a low gas permeable sheet may be advantageously used, and oriented polypropylene/polyethylene laminated film may also be used.

For the packing material, a material with a good cushioning property which may normally be used as a packing attached on the rear surface of a cap or a lid of a container can be used. A sheet shaped packing material can be used, and by using a sheet shaped packing material, the thickness of the packing body can be minimized.

As examples of packing material, rubber materials, such as silicon rubber and urethane rubber, and plastic materials, such as soft polyethylene, polyethylene foam, polystyrene foam, polyurethane foam, vinyl chloride resin foam can be used. Taking into consideration the lamination of the low gas permeable sheet or other material for the packing material, use of polyethylene foam is most preferred.

When selecting the packing material, taking into consideration the oxygen permeability at the side edge of the packing material, a foam member of independent bubbles with an expansion ratio of fivefold or less is preferred.

Preferably, the thickness of the sheet shaped packing material is within a range of approximately 0.2 to 5 mm, taking into consideration the thickness of the oxygen absorbing agent forming a packing for a lid and the sealing property. Moreover, taking into consideration the manufacturing process and the readiness of attaching it to the packing body, the thickness is further preferred to be in a range of approximately 0.5 to 3 mm.

As a low gas permeable sheet, a plastic film having a good sealing property and oxygen stopping property when used for a lid of a container, and which allows an oxygen absorbing agent a long lasting oxygen absorbing function is advantageously used. The oxygen permeability of the low gas permeable sheet is 500 $cc/mm^2 \cdot 24$ Hr. atm or less, preferably 100 $cc/m^2 \cdot 24$ Hr. atm or less, and most preferably 50 $cc/m^2 \cdot 24$ Hr. atm.

This low gas permeable sheet may be either a single substance film or a combined film.

Examples of a single substance film include a plastic film, such as polyethylene terephthalate, polyamide, polyvinylidene chloride, ethylene-vinyl alcohol copolymer or polyvinyl alcohol, a polyvinylidene chloride coated film; an aluminum evaporation film; aluminum foil; and silica evaporation film.

Since this low gas permeable sheet is laminated to the packing material, a combined film being the combination of the above mentioned single substance film and polyolefin resin film, such as polyethylene, EVA (ethylene-vinyl acetate copolymer), ionomer, EAA (ethylene-acrylic acid copolymer), EMMA (ethylene-methyl methacrylate copolymer), EEA (ethylene-ethyl acrylate copolymer), is advantageously used. Examples of such a combined film include various co-extrusion films, such as Triplenylon (manufactured by Ozaki Fine Chemical Co.), BARRIALON (manufactured by Asahi Chemical Industry Co., Ltd.).

Taking into consideration the manufacturing process, the surface of the low gas permeable sheet to be adhered to the gas permeable sheet is preferred to be polyolefin resin, and it is preferred to be a film on both sides of which heat fusion polyolefin resin is co-extruded, placing resins such as Eval (manufactured by Kuraray Co., Ltd.), nylon, polyvinylidene chloride resin in between.

The thickness of the low gas permeable sheet is to be determined taking into consideration the oxygen permeability and the manufacturing process, and preferably in a range of 10 to 100 $\mu$m.

Any type of oxygen absorbing agent may be used without restriction on formula or shape. A package of oxygen absorbing agent containing a powder type oxygen absorbing agent can be used. A sheet type oxygen absorbing agent in which the oxygen absorbing agent is formed into a sheet like shape is preferably used, since it can be formed into a uniformly thin flat shape, is easily handled because of no unevenness, and can be readily processed when manufacturing the packing. A sheet shaped oxygen absorbing agent coated with a gas permeable packaging material can also be used.

A component of the oxygen absorbing agent formed into a sheet shape should not be restricted so long as it can be processed into a sheet shape and has a good oxygen absorbing property. For example, metal-base oxygen absorbing agents, a main ingredient of which is a metallic component, such as iron, or organic-base oxygen absorbing agent, a main ingredient of which is an organic component, such as ascorbic acid, can be used.

Preferred examples of the sheet shaped oxygen absorbing agents which may be used in the present invention include a mixture of polyolefin resin, such as polyethylene, and an iron-based oxygen absorbing agent formed into a sheet shape, such as an oxygen absorbing agent composition comprising iron powder and metal halide, such mixture further oriented to enhance oxygen absorbability (disclosed in the Japanese Patent Laid-Open Publication No.2-72851), or a mixture of iron-base oxygen absorbing agent with pulp or the like formed into a sheet shape, such as an oxygen absorbing agent composition comprising iron powder and metal halide (disclosed in the Japanese Patent Laid-Open Publication No.2-86758). A sheet shaped oxygen absorbing agent wherein a paper or non-woven cloth is saturated with an organic oxygen absorbing agent, such as an ascorbic acid-base oxygen absorbing agent may also be used.

The thickness of the sheet shaped oxygen absorbing agent is approximately 0.1 to 5 mm, preferably 0.2 to 3 mm, taking into consideration the readiness of processing coming from the thickness of a packing material. Thickness or size of the sheet shaped oxygen absorbing agent may be selected at will depending on the required oxygen absorbability (ability to absorb oxygen).

If the oxygen absorbing reaction of the sheet shaped oxygen absorbing agent used in the present invention requires water, either a water dependent type or self-reactive type may be used. However, taking into consideration the manufacturing process and the handling, a water dependent type which uses water evaporated from the stored subject which has had a high water content applied to it is preferred. If the stored subject has low water content, a self reactive type sheet shaped oxygen absorbing agent, containing water in advance, may also be used. An oxygen absorbing resin sheet, making use of the metal catalyser, such as Co, Fe, Cu, Ni, V, Mn or other transition metal element compounds disclosed in the Japanese Patent Laid-Open Publication No.4-45152 may also be used.

The sheet shaped oxygen absorbing agent used in the present invention can be used with a deodorizing sheet, water absorbing resin or water absorbing sheet, carbon dioxide absorbing sheet, or the like, as necessary.

Gas permeable materials generally used for packaging oxygen absorbing agent packages can be used such as the gas permeable sheets mentioned above. For example, a packaging material wherein a porous film is laminated on a paper, water resistive non-woven cloth, such as TYVEK (manufactured by Dupont), Luxer (manufactured by Asahi Chemical Industry Co., Ltd.), various micro-porous films, such as Celgard (manufactured by Celanese Corp.), NF Sheet (manufactured by Tokuyama Soda Co., Ltd.), NITFLON (manufactured by Nitto Denko Corp.), and packaging materials with lamination of said water resistant non-woven cloth and a micro-porous film which have water resisting and oil resisting property as disclosed in the Japanese Patent Laid-Open Publication No.63-219359.

If the oxygen absorbing agent used is coated with a gas permeable packaging material, a general porous plastic film may also be used as a gas permeable sheet.

If the water content of the stored subject is high, such as with a liquid, liquid resistivity is required of the gas permeable sheet in order to prevent any elusion of rust or the like from the oxygen absorbing agent. For this purpose, a packaging material on which a heat resistant porous film, such as polyethylene terephthalate, polyamide, Eval, aluminum foil, is laminated on said water resistant non-woven cloth, microporous film, water resistant and oil resistant packaging material is advantageously used.

More particularly, a packaging material wherein a porous film of polyethylene terephthalate/polyethylene, a porous film of nylon/polyethylene is laminated on the above-mentioned water resistant non-woven cloth, a micro-porous film, a water resistant and oil resistant packaging material, furthermore, a packing material with a three lamination structure wherein a porous polyolefin resin film is laminated on another surface of the above-mentioned laminated packaging material, is preferably used.

No particular restriction is imposed on the manufacturing method of a packing for a lid according to the present invention. By way of example only, such manufacturing method includes the following methods.

First of all, a low gas permeable sheet is laminated and adhered to one surface of the sheet shaped packing material, by heat lamination, dry lamination or extrusion lamination method or the like, to obtain a packing body. Then, a predetermined position of the packing body is punched out in a circular shape with a predetermined size to form an aperture which is capable of storing the oxygen absorbing agent. Then, a plastic film is laminated and adhered to another surface of the packing body, i.e. the side of the packing material (a surface to face the lid), by heat lamination, dry lamination, extrusion lamination method or the like, when necessary. Then, after placing the oxygen absorbing agent into the aperture, a gas permeable sheet is adhered to the low gas permeable sheet by means of a heat roller or with an adhesive agent to seal the aperture. Then such laminated sheet is punched according to a predetermined size suited for the inner diameter of the lid, placing the stored oxygen absorbing agent at its center.

In a packing for a lid obtained by this method, the gas permeability of the side edge of the gas permeable sheet laminated on the packing body can be sufficiently reduced by using a manufacturing process, such as a heat lamination method, and thus it enables the gas permeability of this area to be very small.

In order to further reduce the gas permeability of the packing for a lid, the gas permeable sheet with a diameter smaller than the diameter of the container opening and larger than the inner diameter of the aperture is used, and this gas permeable sheet is laid on the packing body to seal the aperture, and sealed by a heat roller or with an adhesive agent.

The following method for manufacturing a packing for a lid according to the present invention can also be applied.

First of all, a predetermined position of the sheet shaped packing material is punched out in a circular shape with a predetermined size to form an aperture which is capable of storing the oxygen absorbing agent. Then, a low gas permeable sheet is laid on one surface of the sheet shape packing material with the aperture, the inner surface of the aperture is laminated (coated) with the low gas permeable sheet by vacuum forming through sucking from the aperture, and an opening of the aperture to be facing a lid is sealed with the low gas permeable sheet. Then, the surface of the packing materials on the side facing the container is laminated and sealed with the low gas permeable sheet by heat roller (but, the aperture is not sealed) to obtain a packing body. Then, after storing the oxygen absorbing agent in the aperture, a packing for a lid is finished by the same method as described above.

In a packing for a lid obtained by this method, the gas permeability of the side edge of the gas permeable sheet can also be significantly reduced in the same manner as described above.

Similarly, the gas permeability of a packing for a lid can further be reduced by using a gas permeable sheet having a diameter smaller than the diameter of the container opening and larger than the inner diameter of the aperture.

As another manufacturing method of a packing for a lid according to the present invention, the following method can also be used.

A low gas permeable sheet is laminated and adhered to one surface of the sheet shaped packing material through such method as heat lamination, dry lamination or extrusion lamination to obtain a packing body. At this time, a low gas permeable sheet or a plastic film may also be laminated and adhered to another surface, when necessary. A gas permeable sheet with a size larger than the outer surface of the oxygen absorbing agent to be used and smaller than the diameter of the container opening is prepared. After placement on the low gas permeable surface of the packing body, the oxygen absorbing agent is covered with the gas permeable sheet. Then, a periphery of the gas permeable sheet surrounding the oxygen absorbing agent is heat sealed. After which, the packing body is punched out with a predetermined size suited for an inner surface of the lid placing the stored oxygen absorbing agent at its center to finish the packing for a lid.

As another method, an oxygen absorbing agent is placed on the low gas permeable sheet surface of the packing body, and covered with a gas permeable sheet whose periphery is heat sealed. Then, an unnecessary portion of the gas permeable sheet is removed. This method is suited for mass production. In this method, if the packing for a lid is not immediately placed on the lid, a low gas permeable film is first laminated and adhered to both surfaces of the packing material, and a low gas permeable and strippable material is laminated on a surface where the unnecessary portion of the gas permeable sheet is removed, to protect both surfaces of the packing for a lid, and thus it may be stored without causing damage to the oxygen absorbing capacity.

DETAILED DESCRIPTION OF PREFERRED EMBODIMENTS

The present invention is now described in detail referring to the embodiments. The present invention is not intended to be limited to these embodiments.

The sheet shaped oxygen absorbing agent used for a packing for a lid according to the present invention is produced according to the following method.

Production of the sheet shaped oxygen absorbing agent

A mixture of 100 parts of iron-based oxygen absorbing agent with an average granule diameter of 70 μm is coated with sodium chloride and 100 parts of polyethylene is heat melted at a temperature of 190° C., and formed into a sheet shape by using an extrusion machine. Then, this sheet is oriented to the lateral direction at a temperature of 50° C. to four times the original size to obtain a high performance sheet shaped oxygen absorbing agent with 1 mm thickness.

The sheet shaped oxygen absorbing agent so obtained is punched out in a circular shape with a diameter of 18 mmΦ in order to prepare a circular shaped oxygen absorbing agent (diameter: 18 mmΦ, thickness: 1 mm) to be stored in a packing for a lid.

Using the sheet shaped oxygen absorbing agent so produced, the following three types of packing for a lid are produced.

First Embodiment

Figure 1:
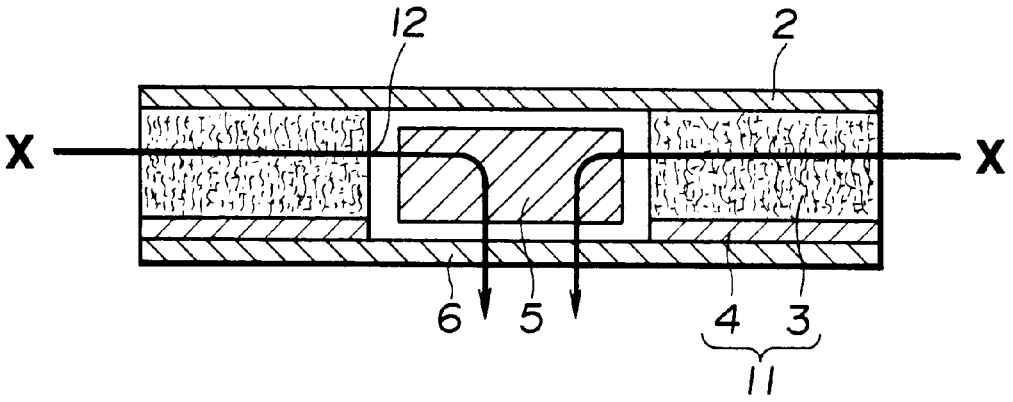
FIG. 1 is a cross section of a packing for a lid according to the first embodiment.

As shown in FIG. 1, a low gas permeable sheet 4 (thickness: 30 μm) consisting of Triplenylon (manufactured by Ozaki Fine Chemical Co. (a laminated film comprising a three layer structure of polyethylene/nylon/polyethylene)) is laid on one surface of the sheet shaped packing material 3 (thickness: 1.5 mm) consisting of polyethylene foam, and the sheet shaped packing material 3 and the low gas permeable sheet 4 is laminated and adhered by heat rolling to obtain a packing body 11. Then, the center portion of the packing body 11 is punched out in a circular shape with a diameter of 20 mmΦ, to form an aperture 12. This aperture 12 will become an oxygen absorbing agent storing area. Then, laminate film 2 comprising a two layer structure of polyethylene terephthalate (thickness: 12 μm)/polyethylene (thickness: 15 μm) is laminated and adhered to the packing material 3 surface of the packing body 11 in which the aperture 12 is formed, matching the surfaces of the polyethylene.

Additionally, a gas permeable sheet 6 produced by heat lamination of a porous film (pore diameter: 0.8 mmΦ, rate of hole area: 7%) which is produced by perforating a film comprising a two layer structure of oriented nylon (thickness: 15 μm)/polyethylene (thickness: 15 μm) laminated film and a water resisting non-woven cloth, Luxer (manufactured by Asahi Chemical Industry Co., Ltd.), is prepared.

Then, the above-mentioned sheet shaped oxygen absorbing agent 5 (diameter: 18 mmΦ, thickness: 1 mm) is stored in the aperture 12 of the packing body 11. The above-mentioned gas permeable sheet 6 is then laminated on the low gas permeable sheet 4 surface of the packing body 11 in which the oxygen absorbing agent 5 is stored and they are adhered to each other by using a heat roller. The packing body 11 on which the gas permeable sheet 6 is adhered is punched out in a circular shape with a size suited for a lid to which the packing is attached (40 mmΦ in this embodiment) in such manner as the aperture 12 in which the sheet shaped oxygen absorbing agent 5 is stored is positioned at the center, to obtain a packing for a lid.

Figure 2:
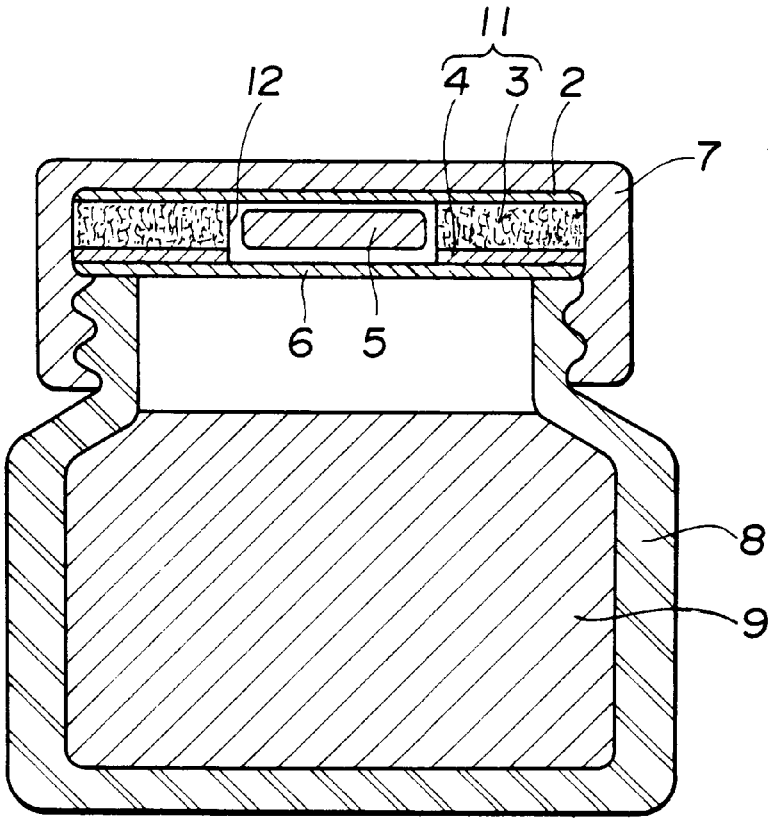
FIG. 2 is a cross section of a container covered with a lid in which a packing for a lid according to a first embodiment of the invention is placed.

As shown in FIG. 2, this packing for a lid is attached to a predetermined position of the inside of a predetermined lid 7 to cover an opening of the container 8 in which the stored subject 9 is placed, and seals the inside of the container 8. Since a low gas permeable sheet 4 is provided at portions in contact with the inside of the container 8 other than the aperture 12 in this packing for a lid, exterior air entering from the side edge of the packing material 3 passes, as shown by arrow X in FIG. 1, through the aperture 12 in which the oxygen absorbing agent 5 is stored to the inside of the container 8. At this time, exterior air is absorbed into the oxygen absorbing agent 5, and the air does not substantially enter into the container 8.

Figure 3:
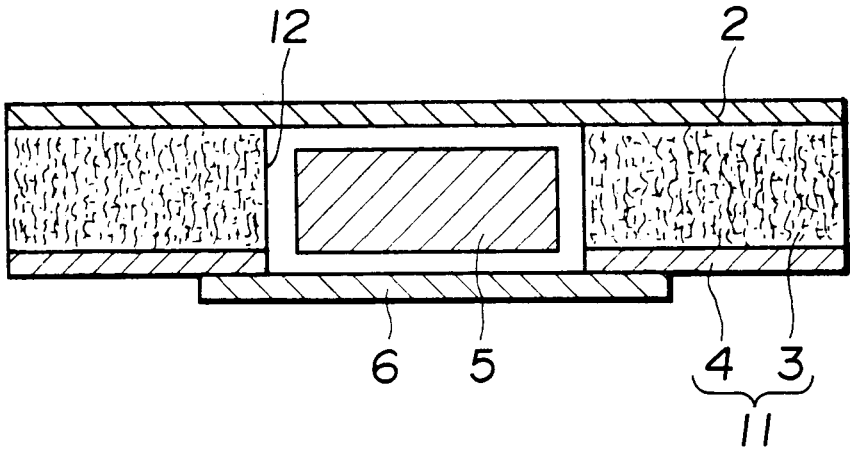
FIG. 3 is a cross section of another packing for a lid according to the first embodiment.

As shown in FIG. 3, the packing for a lid according to the present embodiment may be cut out to have a diameter smaller than the inner diameter of the opening of the container 8 and larger than the outer diameter of the aperture 12. By such a structure, the side edge of the gas permeable sheet 6 is not exposed to the atmosphere. Therefore, exterior air does not enter from the side edge of the gas permeable sheet 6, and an outstanding oxygen stopping property is further granted, and allows the oxygen absorbing function of the oxygen absorbing agent 5 to last longer.

Second Embodiment

Figure 4:
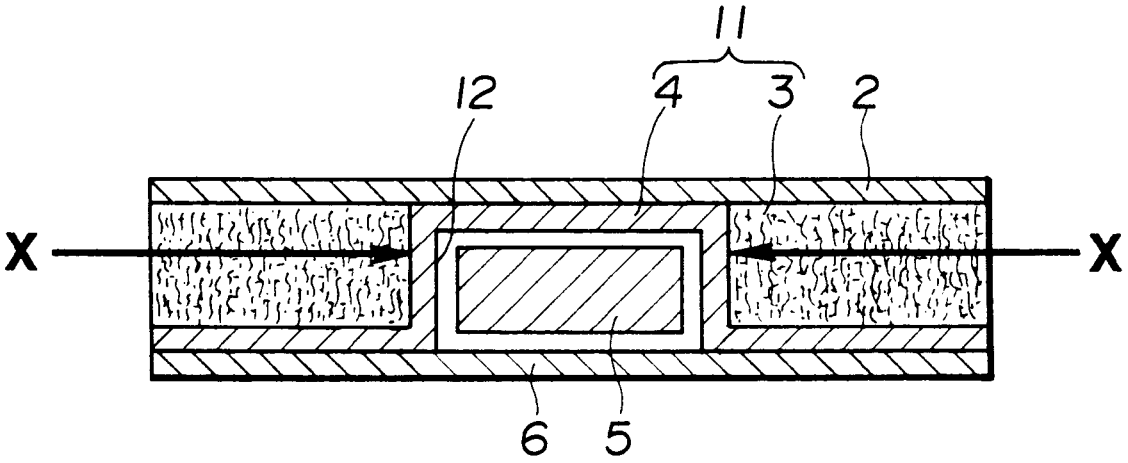
FIG. 4 is a cross section of a packing for a lid according to a second embodiment of the invention.

As shown in FIG. 4, an aperture 12 is formed by punching out the center of the sheet shape packing material 3 (thickness: 1.5 mm) consisting of polyethylene foam in a circular shape with a diameter of 20 mmΦ. On one surface of the sheet shaped packing material 3 having the aperture 12, a low gas permeable sheet 4 (thickness: 30 μm) consisting of Triplenylon (manufactured by Ozaki Fine Chemical Co. (a laminate film comprising a three layer structure of polyethylene/nylon/polyethylene)) is layered. This low gas permeable sheet 4 is sucked from the rear side of the aperture 12, and the inner surface of the aperture is laminated (coated) with a low gas permeable sheet through a vacuum forming method, and seals one opening of the aperture 12. The low gas permeable sheet 4 and the sheet shaped packing material 3 is laminated and adhered by heat rolling to obtain a packing body 11.

In addition, a gas permeable sheet 6 produced by heat lamination of a porous film (pore diameter: 0.8 mmΦ, rate of hole area: 7%) which is produced by perforating a film comprising a two layer structure of oriented nylon (thickness: 15 μm)/polyethylene (thickness: 15 μm) laminated film and a water resisting non-woven cloth, Luxer (manufactured by Asahi Chemical Industry Co., Ltd.), is prepared.

Then, the above mentioned sheet shaped oxygen absorbing agent 5 (diameter: 18 mmΦ, thickness: 1 mm) is stored in the aperture 12 of the packing body 11. The above-mentioned gas permeable sheet 6 is then laminated on the low gas permeable sheet 4 surface of the packing body 11 in which the oxygen absorbing agent 5 is stored and they are adhered to each other by a heat roller. On another side of the packing body 11 on which the gas permeable sheet 6 is not laminated, the laminate film 2 comprising a two layer structure of polyethylene terephthalate (thickness: 12 μm)/polyethylene (thickness: 15 μm) is heat laminated, matching the polyethylene sides. The packing body 11 on which this film 2 is adhered is punched out in a circular shape with a size suited for a lid to which the packing is attached (40 mmΦ in this embodiment) in such a manner as aperture 12 in which the sheet shaped oxygen absorbing agent 5 is stored is positioned at the center, to produce a packing for a lid.

Figure 5:
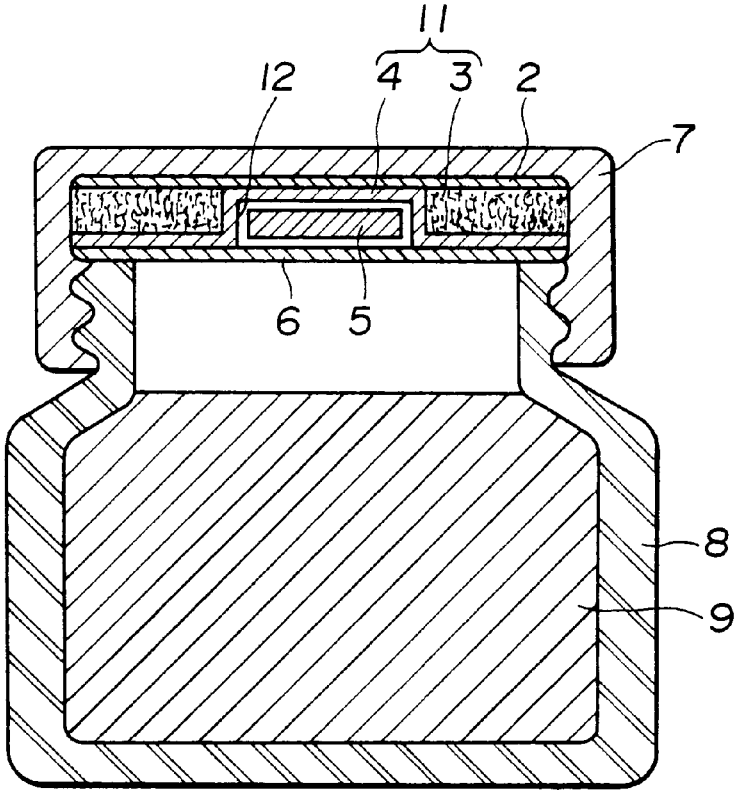
FIG. 5 is a cross section of a container covered with a lid in which a packing for a lid according to the second embodiment is placed.

As shown in FIG. 5, this packing for a lid is attached to a predetermined position of the inside of a predetermined lid 7 to cover an opening of the container 8 in which the stored subject 9 is placed, and sealed to the inside of the container 8. In this packing for a lid, exterior air entering from the side edge of the packing material is stopped by the low gas permeable sheet 6 as shown by arrow X in FIG. 4, and is prevented from entering into the container 8.

Figure 6:
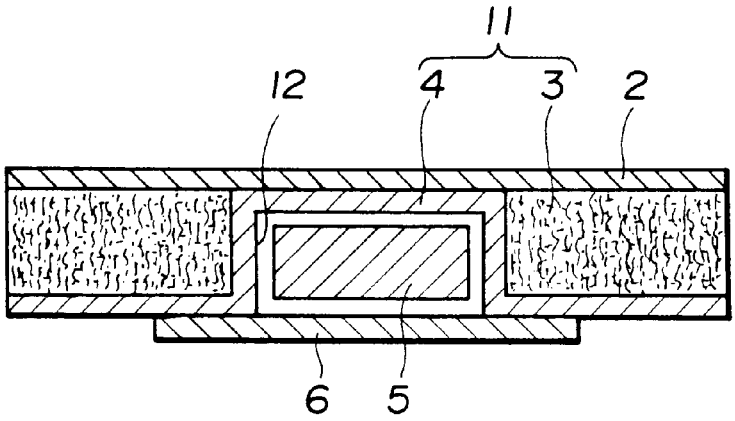
FIG. 6 is a cross section of another packing for a lid according to the second embodiment.

As shown in FIG. 6, the packing for a lid according to the present embodiment may be cut out to have a diameter smaller than the inner diameter of the opening of the container 8 and larger than the outer diameter of the aperture 12. By such a structure, the side edge of the gas permeable sheet is not exposed to the atmosphere. Therefore, exterior air does not enter from the side edge of the gas permeable sheet 6, and an outstanding oxygen stopping property is further obtained, which allows the oxygen absorbing function of the oxygen absorbing agent 5 to last longer.

Third Embodiment

Figure 7:
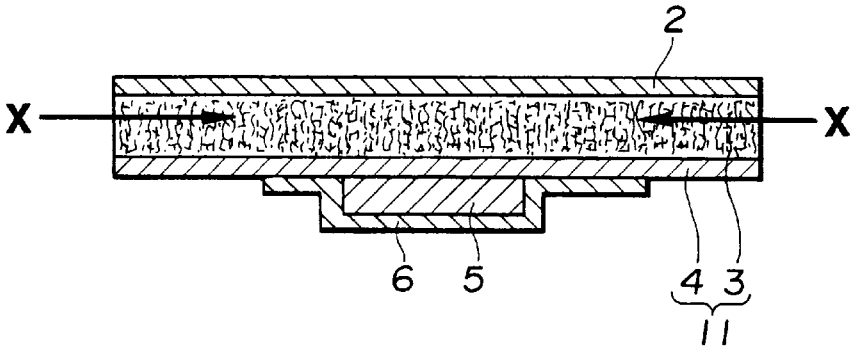
FIG. 7 is a cross section of a packing for a lid according to a third embodiment of the invention.

As shown in FIG. 7, a low gas permeable sheet 4 (thickness: 30 μm) consisting of Triplenylon (manufactured by Ozaki Fine Chemical Co. (a laminated film comprising three layer structure of polyethylene/nylon/polyethylene)) is laid on one surface of the sheet shaped packing material 3 (thickness: 1.5 mm) consisting of polyethylene foam, and the sheet shaped packing material 3 and the low gas permeable sheet 4 is laminated and adhered by heat rolling to obtain a packing body 11.

Now, the above-mentioned low gas permeable sheet 4 may be used instead of the laminate film 2 used in the first and second embodiments, in which case, the low gas permeable sheet is laminated and adhered to both surfaces of the sheet shaped packing material 3.

On the other hand, a gas permeable sheet 6 produced by heat lamination of a porous film (pore diameter: 0.8 mmΦ, rate of hole area: 7%) which is produced by perforating a film comprising a two layer structure of oriented nylon (thickness: 15 μm)/polyethylene (thickness: 15 μm) and a water resistant non-woven cloth, Luxer (manufactured by Asahi Chemical Industry Co., Ltd.), is punched out in a circular shape with a diameter of 30 mmΦ.

The above-mentioned oxygen absorbing agent 5 (diameter: 18 mmΦ, thickness: 1 mm) is provided on a low gas permeable sheet 4 surface of the packing body 11. The gas permeable sheet 6 so punched out in a circular shape is laid on the low gas permeable sheet 4 in such a manner as to cover the sheet shaped oxygen absorbing agent 5, and the periphery thereof is heat sealed. The packing body 11 on which the gas permeable sheet 6 is adhered is punched out in a circular shape with a size suited for a lid to which the packing is attached (40 mmΦ in this embodiment) in such a manner as the portion on which the sheet shaped oxygen absorbing agent 5 is provided is positioned at the center, to produce a packing for a lid.

Figure 8:
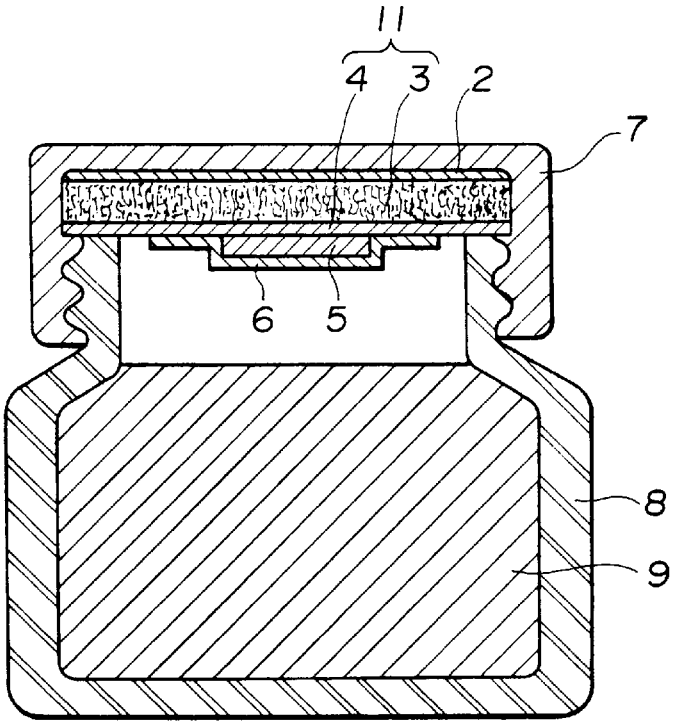
FIG. 8 is a cross section of a container covered with a lid in which a packing for a lid according to the third embodiment is placed.
Figure 9:
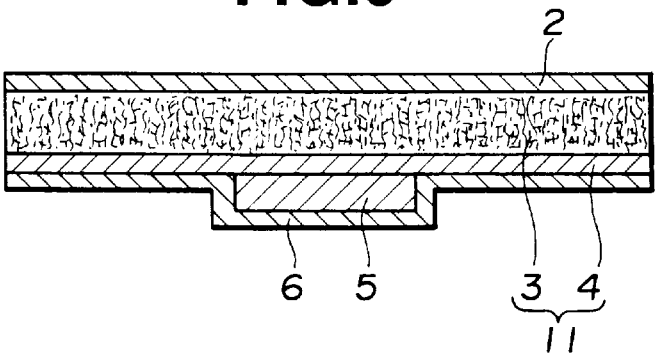
FIG. 9 is a cross section of another packing for a lid according to the third embodiment.

As shown in FIG. 8, this packing for a lid is attached to a predetermined position of the inside of a predetermined lid 7 to cover an opening of the container 8 in which the stored subject 9 is stored, and seals the inside of the container 8. In this packing for a lid, exterior air entering from the side edge of the packing material 3 is stopped by the low gas permeable sheet 6 as shown by arrow X in FIG. 7 and is prevented from entering into the container 8. As shown in FIG. 9, in the packing for a lid according to the present embodiment, the gas permeable sheet 6 surrounding the sheet shaped oxygen absorbing agent 5 may have the same size as the packing body 11. By doing this, the side edge of the gas permeable sheet is not exposed to the atmosphere. Therefore, exterior air does not enter from the side edge of the gas permeable sheet 6, and an outstanding oxygen stopping property is further detained, and eventually allows the oxygen absorbing function of the oxygen absorbing agent 5 to last longer.

A preservation test of miso (soy bean paste) was conducted by covering containers containing miso with lids to which packing for a lid obtained from the first, second and third embodiments were attached as mentioned above.

The Preservation Test of Miso

Glass jars with a capacity of 100 cc are filled with miso leaving a 20 cc empty space at their upper portion, and then an oxygen detection agent ("EGELESS-I-EIE" manufactured by Mitsubishi Gas Chemical) is placed in the jars. These glass jars are sealed with caps wherein the packing for a lid obtained as mentioned in the first, second and third embodiments are attached to their respective rear sides in such a manner that the gas permeable sheet surface of the packing faces the miso. The miso contained in the glass jars sealed with the packing for a lid is kept at a temperature of 25° C. to observe the change in color of the oxygen detective agent and miso contained in the jars.

Results of this preservation test of miso are shown in Table 1.

For the purpose of comparison, a packing for a lid manufactured in the following methods, Comparison 1 and 2, are also used for the same preservation test of miso and the results are also shown in Table 1.

Comparison 1

The polyethylene surface of the polyethylene terephthalate (12 μm)/polyethylene (15 μm) laminate film is matched with one surface of the sheet shaped packing material (thickness: 1.5 mm) consisting of polyethylene foam with a circular punched hole with a diameter of 20 mmΦ at its center in the same manner as described in the first embodiment, and they are laminated and adhered to each other. The same oxygen absorbing agent as described in the first embodiment (diameter: 18 mmΦ, thickness: 1 mm) is stored in the circular punched out portion of the laminated sheet shaped packing material, and the same gas permeable sheet as shown in the first embodiment is laminated and adhered to the laminated sheet shaped packing material in the same manner as described in the first embodiment.

The laminated packing material in which the sheet shaped oxygen absorbing agent is stored is punched out in the circular shape with a diameter of 40 mmΦ placing the oxygen absorbing agent storing portion at its center, to produce the packing for a lid.

Comparison 2

A packing for a lid is produced by punching out the same sheet shaped packing material consisting of polyethylene foam as described in the first embodiment (thickness: 1.5 mm) in a circular shape with a diameter of 40 mmΦ.

Glass jars were filled with miso in the same manner as described in the first, second and third embodiments using these comparison packings for a lid, and the preservation test of miso was conducted.

TABLE 1

| | 2 days later | 30 days later | |
|---|---|---|---|
| | Color of Oxygen Detection Agent | Color of Oxygen Detection Agent | Color of surface of miso |
| First Embodiment | Pink ($O_2$: 0.1% or less) | Pink ($O_2$: 0.1% or less) | Normal (Maintained initial color) |
| Second Embodiment | Pink ($O_2$: 0.1% or less) | Pink ($O_2$: 0.1% or less) | Normal (Maintained initial color) |
| Third Embodiment | Pink ($O_2$: 0.1% or less) | Pink ($O_2$: 0.1% or less) | Normal (Maintained initial color) |
| Comparison 1 | Purple ($O_2$: approx. 0.5%) | Blue ($O_2$: 0.5% or more) | Brown (Changed to brown due to oxidation) |
| Comparison 2 | Blue ($O_2$: 0.5% or more) | Blue ($O_2$: 0.5% or more) | Brown to Blackish Brown (Changed to brown due to oxidation) |

Note: Range of oxygen content displayed by the color by oxygen detective agent.

| Color: | Blue | Purple | Pink |
|---|---|---|---|
| Oxygen Content: | >0.5% | 0.5%–0.1% | <0.1% |

It is apparent from Table 1 that the oxygen content within the glass jars is kept at level of 0.1% or less and the color of the surface of miso remains normal, even after 30 days of storage, in the first, second and third embodiments. On the contrary, in comparisons 1 and 2, the oxygen content within the glass jar increased to 0.5% or more, and after 30 days of storage, the color of the surface of miso changed to brown due to oxidiation, showing that the quality of miso deteriorated.

As a result, it was demonstrated that a packing for a lid according to the first, second and third embodiments has an outstanding oxygen stopping property, and may be able to allow the oxygen absorbing function of the oxygen absorbing agent to last longer.

Since the packing for a lid having an oxygen absorbing property according to the present invention comprises a structure as discussed above, they have an outstanding sealing property, water resistance, safety and sanitary properties, as well as a high oxygen absorbing property. In particular, since its packing surface has a significant oxygen stopping property, the oxygen absorbing function of the oxygen absorbing agent can last long. The shape of the packing is also extremely thin and compact, enabling easy attachment to a lid, simplifying the manufacturing process, and making commercial production easy.

In particular, by using the structure of laminating and adhering a non-gas permeable plastic film on the inner surface of the sheet shaped packing material facing the container, disadvantageous aspects of the packing material having oxygen permeability are supplemented and a packing for a lid according to the present invention has a significant sealing property. Furthermore, by using a sheet shaped oxygen absorbing agent, any possibility of contamination due to powder, etc. in the course of the manufacturing process can be eliminated, and the particular composition of the materials prevents the elution of components of an oxygen absorbing agent, such as rust. Therefore, the packing for a lid has significant safety and sanitary properties.

Accordingly, a packing for a lid according to the present invention has high liquid resistance, and thus may be used to seal various containers, in which foodstuffs, such as juice, liquor, wine, other liquid drinks, shiokara, tsukudani, jam, marmalade, sake-fureiku or other foodstuffs with high water content, or pharmaceuticals are contained. A packing for a lid according to the present invention has significant effect in the maintenance of quality of articles which easily deteriorate with oxygen, or which easily decay or transform with propagation of microbes.

What is claimed is:

1. Packing for a lid for sealing a container opening comprising:

a packing body comprising a packing material having a cavity and a low gas permeable sheet laminated on a surface of said packing material, said low gas permeable sheet being a combination of a first film selected from the group consisting of polyethylene terephthalate, polyamide, polyvinylidene chloride, ethylene-vinyl alcohol copolymer, polyvinyl alcohol, evaporated aluminum, aluminum foil, and evaporated silica, and a second, polyolefin resin film selected from the group consisting of polyethylene, ethylene vinyl acetate, ionomer, ethylene-acrylic acid copolymer, ethylene-methyl methacrylate copolymer, and ethylene-ethyl acrylate copolymer;

a gas permeable sheet disposed on said low gas permeable sheet with said low gas permeable sheet interposed between said packing material and said gas permeable sheet wherein an outer diameter of said gas permeable sheet is smaller than an outer diameter of said packing material;

a plastic film laminated on a surface of said packing material opposite a surface of said packing material on which said low gas permeable sheet is disposed; and an oxygen absorbing agent disposed in the cavity in said packing material adjacent and covered by said gas permeable sheet.

2. The packing for a lid according to claim 1, wherein said oxygen absorbing agent has a sheet shape.

3. The packing for a lid according to claim 1, wherein said packing material has a sheet shape.

4. The packing for a lid according to claim 1, wherein the oxygen permeability of said low gas permeable sheet is no more than 500 $cc/m^2 \cdot 24\ Hr \cdot atm$.

5. The packing for a lid according to claim 1, wherein the cavity extends through said packing body.

6. The packing for a lid according to claim 1, wherein said low gas permeable sheet is also a lining of the cavity except at an opening of the cavity facing said gas permeable film.

7. The packing for a lid according to claim 1, wherein the oxygen permeability of said low gas permeable sheet is no more than 100 cc/$m^2$·24 Hr·atm.

8. The packing for a lid according to claim 1, wherein the oxygen permeability of said low gas permeable sheet is no more than 50 cc/$m^2$·24 Hr·atm.

9. The packing for a lid according to claim 1 wherein said low gas permeable sheet includes two layers of the second, polyolefin resin film sandwiching the first film.

10. The packing for a lid according to claim 1, wherein said oxygen absorbing agent is selected from the group consisting of a sheet of a polyolefin-based resin including an iron-based oxygen absorbing agent, an oriented sheet of a polyolefin-based resin including an iron-based oxygen absorbing agent, and a sheet of pulp including an iron-based oxygen absorbing agent.

11. The packing for a lid according to claim 10, wherein the oxygen absorbing agent comprises iron powder and a metal halide.

12. The packing for a lid according to claim 1, wherein said packing material is selected from the group consisting of a rubber-based material and a plastic material.

13. The packing for a lid according to claim 12, wherein said rubber-based material is selected from the group consisting of silicone rubber and urethane rubber.

14. The packing for a lid according to claim 12, wherein said plastic material is selected from the group consisting of soft polyethylene, polyethylene foam, poly-styrene foam, polyurethane foam, and polyvinyl chloride foam.

15. Packing for a lid for sealing a container opening comprising:

a packing body comprising a packing material and a low gas permeable sheet laminated on a surface of said packing material, said low gas permeable sheet being a combination of a first film selected from the group consisting of polyethylene terephthalate, polyamide, polyvinylidene chloride, ethylene-vinyl alcohol copolymer, polyvinyl alcohol, evaporated aluminum, aluminum foil, and evaporated silica, and a second, polyolefin resin film selected from the group consisting of polyethylene, ethylene vinyl acetate, ionomer, ethylene-acrylic acid copolymer. ethylene-methyl methacrylate copolymer, and ethylene-ethyl acrylate copolymer;

an oxygen absorbing agent disposed on a surface of said low gas permeable sheet; and a gas permeable sheet covering and securing said oxygen absorbing agent to said packing body.

16. The packing for a lid according to claim 15, wherein an outer diameter of said gas permeable sheet is smaller than an outer diameter of said packing material.

17. The packing for a lid according to claim 15, wherein a plastic film is laminated on a surface of said packing material opposite a surface of said packing material on which said low gas permeable sheet is disposed.

18. The packing for a lid according to claim 15, wherein the oxygen permeability of said low gas permeable sheet is no more than 500 cc/$m^2$·24 Hr·atm.

19. The packing for a lid according to claim 15, wherein the oxygen permeability of said low gas permeable sheet is no more than 100 cc/$m^2$·24 Hr·atm.

20. The packing for a lid according to claim 15, wherein the oxygen permeability of said low gas permeable sheet is no more than 50 cc/$m^2$·24 Hr·atm.

21. The packing for a lid according to claim 15 wherein said low gas permeable sheet includes two layers of the second, polyolefin resin film sandwiching the first film.

22. A lid for attachment to a container having an opening, thereby sealing the opening, the lid comprising:

a lid body; and a packing disposed on said lid body, said packing comprising:

a packing body including a packing material and a low gas permeable sheet laminated on a surface of said packing material for facing the container, said low gas permeable sheet being a combination of a first film selected from the group consisting of polyethylene terephthalate, polyamide, polyvinylidene chloride, ethylene-vinyl alcohol copolymer, polyvinyl alcohol, evaporated aluminum, aluminum foil, and evaporated silica, and a second, polyolefin resin film selected from the group consisting of polyethylene, ethylene vinyl acetate, ionomer, ethylene-acrylic acid copolymer, ethylene-methyl methacrylate copolymer, and ethylene-ethyl acrylate copolymer;

a gas permeable sheet disposed on said low gas permeable sheet for facing the container, said low gas permeable sheet being disposed between said packing material and said gas permeable sheet; and an oxygen absorbing agent disposed in the cavity in said packing body and covered by said gas permeable sheet.

23. The lid according to claim 22 wherein said low gas permeable sheet includes two layers of the second, polyolefin resin film sandwiching the first film.

24. A lid for attachment to a container having an opening, thereby sealing the opening, the lid comprising:

a lid body; and a packing disposed on said lid body, said packing comprising:

a packing body including a packing material and a low gas permeable sheet laminated on a surface of said packing material for facing a container, said low gas permeable sheet being a combination of a first film selected from the group consisting of polyethylene terephthalate, polyamide, polyvinylidene chloride, ethylene-vinyl alcohol copolymer, polyvinyl alcohol, evaporated aluminum, aluminum foil, and evaporated silica, and a second, polyolefin resin film selected from the group consisting of polyethylene, ethylene vinyl acetate, ionomer, ethylene-acrylic acid copolymer, ethylene-methyl methacrylate copolymer, and ethylene-ethyl acrylate copolymer;

an oxygen absorbing agent disposed on a surface of said low gas permeable sheet; and a gas permeable sheet covering and securing said oxygen absorbing agent to said packing body.

25. The lid according to claim 24 wherein said low gas permeable sheet includes two layers of the second, polyolefin resin film sandwiching the first film.

26. The lid according to claim 24, wherein said low gas permeable sheet is coextensive with said packing material.

27. The lid according to claim 26, wherein an outer diameter of said low gas permeable sheet is substantially equal to the outer diameter of said packing material.

* * * * *